US010799744B1

(12) United States Patent
Maresh

(10) Patent No.: US 10,799,744 B1
(45) Date of Patent: Oct. 13, 2020

(54) VIBRATION PULLEY SYSTEM FOR EXERCISE APPARATUS

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 46 days.

(21) Appl. No.: 15/813,145

(22) Filed: Nov. 14, 2017

Related U.S. Application Data

(60) Provisional application No. 62/497,265, filed on Nov. 14, 2016.

(51) Int. Cl.

| | |
|---|---|
| ***A63B 21/00*** | (2006.01) |
| ***A63B 21/062*** | (2006.01) |
| *A63B 21/045* | (2006.01) |
| *A63B 23/12* | (2006.01) |

(52) U.S. Cl.
CPC .... *A63B 21/00196* (2013.01); *A63B 21/0626* (2015.10); *A63B 21/154* (2013.01); *A63B 21/4035* (2015.10); *A63B 21/045* (2013.01); *A63B 23/1209* (2013.01)

(58) Field of Classification Search
CPC ..... A63B 21/00196; A63B 21/045; A63B 21/0626; A63B 21/154; A63B 21/4035; A63B 23/1209; B66D 3/04; B66D 3/06; B66D 3/08
See application file for complete search history.

(56) References Cited

U.S. PATENT DOCUMENTS

| | | | | |
|---|---|---|---|---|
| 5,951,444 | A * | 9/1999 | Webber | A63B 21/0628 254/399 |
| 6,015,371 | A * | 1/2000 | Davitt | A63B 21/0552 428/121 |
| 6,494,817 | B2 * | 12/2002 | Lake | A63B 21/154 482/93 |
| 7,695,414 | B2 * | 4/2010 | Tiahrt | A63B 21/00196 482/133 |
| 9,028,381 | B2 * | 5/2015 | Mestemaker | A63B 21/0414 482/129 |
| 9,764,177 | B2 * | 9/2017 | Baudhuin | A63B 21/4017 |
| 9,889,332 | B2 * | 2/2018 | Bowles | A63B 21/018 |
| 9,914,008 | B2 * | 3/2018 | Shavell | A63B 21/068 |
| 10,143,880 | B1 * | 12/2018 | Boatwright | A63B 21/075 |
| 2009/0118098 | A1 * | 5/2009 | Yeh | A63B 22/00 482/4 |
| 2018/0280755 | A1 * | 10/2018 | Dwork | A63B 21/4009 |

* cited by examiner

*Primary Examiner* — Megan Anderson
(74) *Attorney, Agent, or Firm* — Nick A Nichols, Jr.

(57) ABSTRACT

In an exercise apparatus incorporating a vibration pulley system, a vibration unit connected to the frame of the exercise apparatus. The vibration unit may include a toothed pulley and a contact roller mounted on a bracket. A pulley cable may include an end fixedly secured to the frame of the exercise apparatus. The pulley cable may be threaded about the toothed pulley and the opposite end of the pulley cable connected to a handle that may be grasped by an operator. The toothed pulley may be in engagement with the contact roller to generate vibrations that may be felt by the operator. The vibration intensity may be adjusted to variable levels.

9 Claims, 7 Drawing Sheets

VIBRATION PULLEY SYSTEM FOR EXERCISE APPARATUS

CROSS-REFERENCE TO RELATED APPLICATION

This application claims priority to and the benefit of the filing date of U.S. Provisional Application Ser. No. 62/497,265, filed Nov. 14, 2016, which application is herein incorporated by reference in its entirety.

BACKGROUND

The present invention relates generally to fitness equipment, and more particularly, to strength fitness equipment utilizing a cable and pulley system for inducing vibration at the user interface.

Vibration therapy and the benefits thereof is known in the art. Various exercise machines include vibrating platforms which typically vibrate the user's body. The benefits of vibration while performing various types of exercise, including strength fitness, may include without limitation, improvements in vascular circulation, stamina, muscle strength, and various other benefits throughout the user's body.

SUMMARY

In an exercise apparatus incorporating a vibration pulley system, a vibration unit connected to the frame of the exercise apparatus. The vibration unit may include a toothed pulley and a contact roller mounted on a bracket. A pulley cable may include an end fixedly secured to the frame of the exercise apparatus. The pulley cable may be threaded about the toothed pulley and the opposite end of the pulley cable connected to a handle that may be grasped by an operator. The toothed pulley may be in engagement with the contact roller to generate vibrations that may be felt by the operator. The vibration intensity may be adjusted to variable levels.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
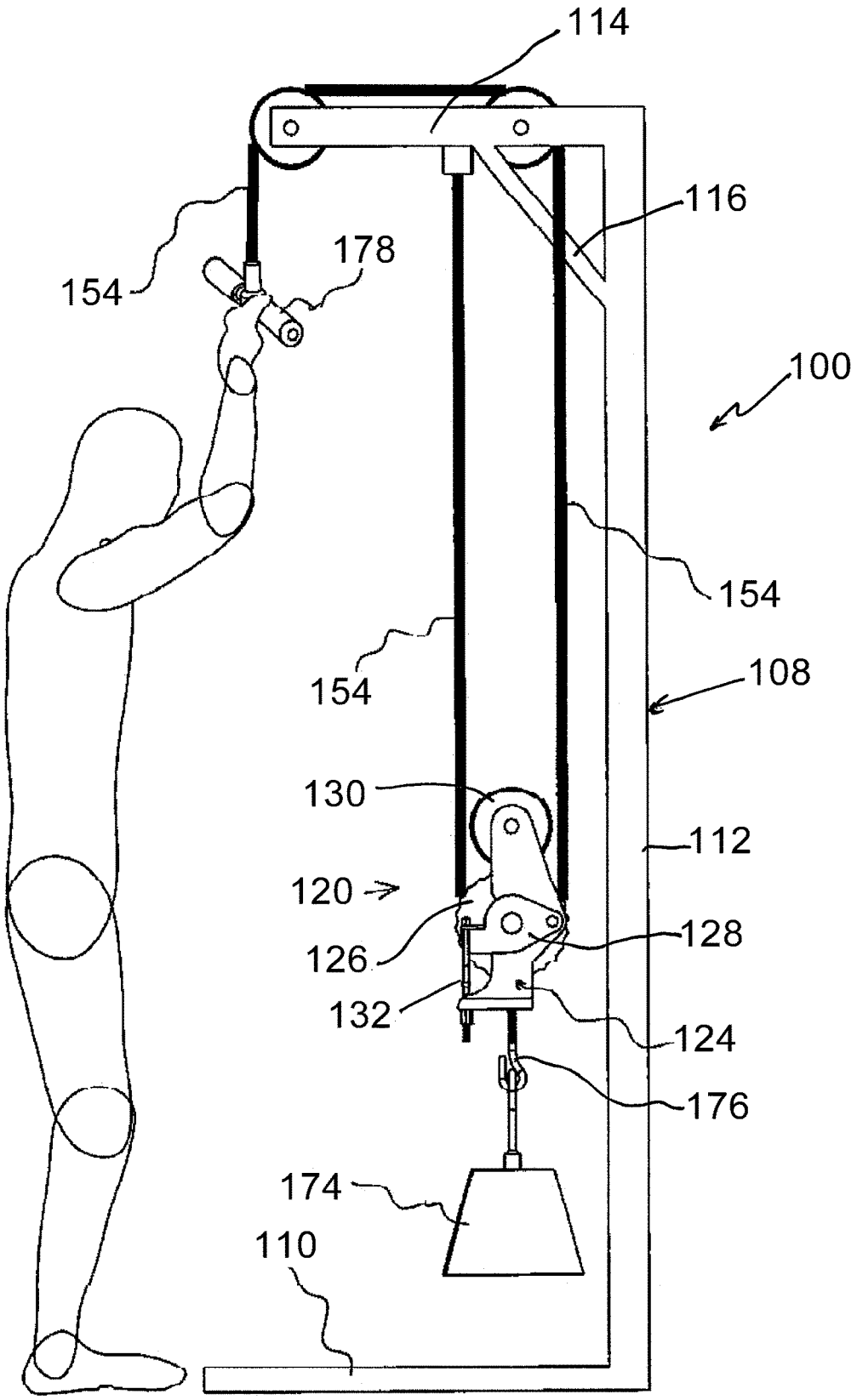
FIG. 1 is a side view of an exercise apparatus including a vibration pulley system.
Figure 2:
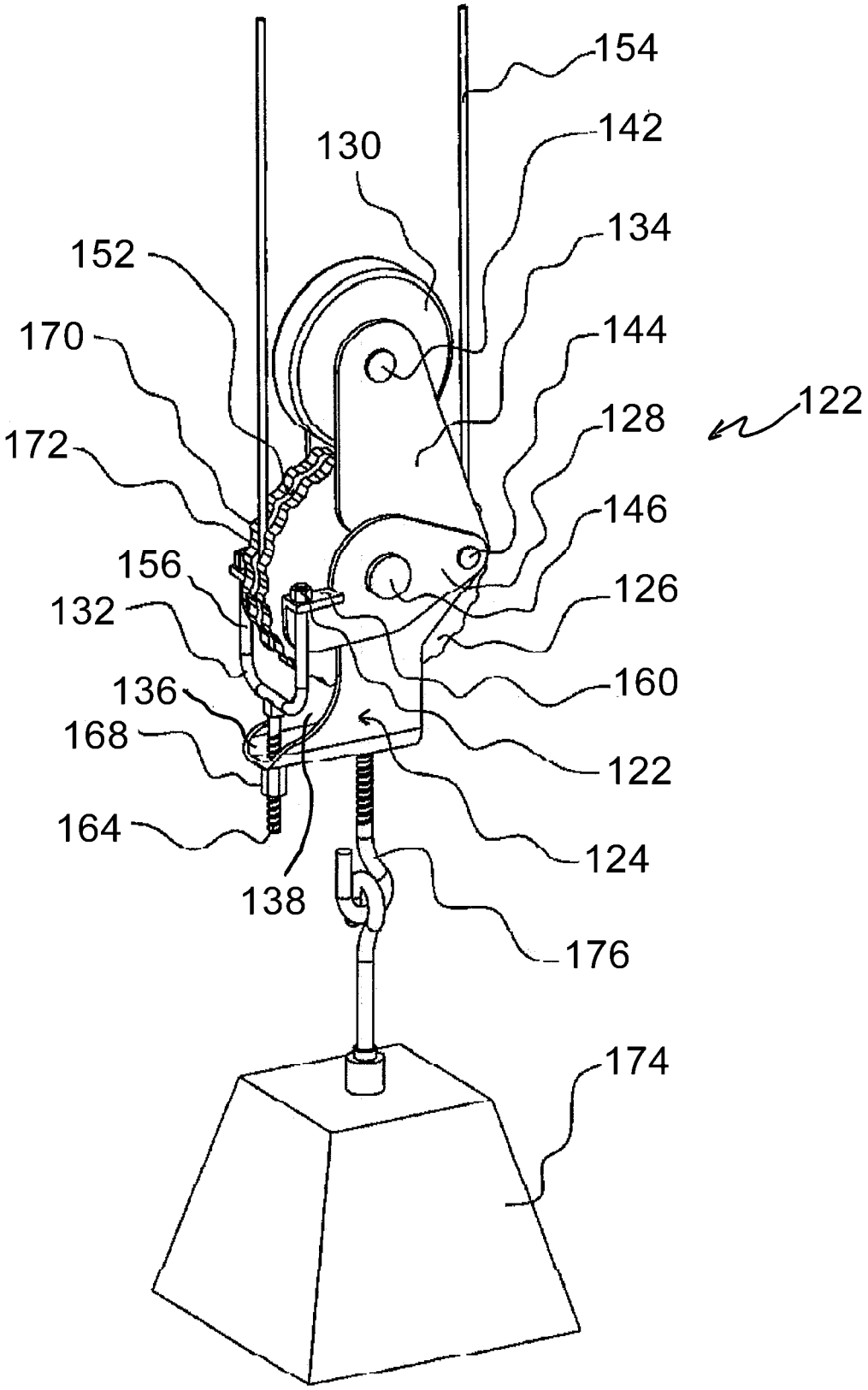
FIG. 2 is a partial perspective view of the vibration pulley system shown in FIG. 1.

Referring first to FIG. 1, an illustrative embodiment of an exercise apparatus incorporation a vibration pulley system is generally identified by the reference numeral 100. The exercise apparatus 100 may include frame 108 comprising a base 110, a stanchion 112 extending upward generally vertically from the base 110, a frame arm 114 extending generally horizontally from proximate an upper distal end of the stanchion 112. A brace member 116 may be secured between the stanchion 112 and the arm 114.

A vibration pulley assembly 120 may be movably supported by the exercise apparatus 100. The vibration pulley assembly 120 may include a vibration unit 122 comprising a pulley support bracket 124, a toothed pulley 126, a pair of toothed pulley support members 128, a contact roller 130, and a bracket member 132, depicted in the drawings as yoke-shaped for purposes of illustration but not by way of limitation. The bracket 124 may be substantially U-shaped and may include side members 134 extending vertically upward from a base member 136. The side members 134 may be spaced apart and parallel relative to one another and define a channel 138 therebetween.

Figure 3:
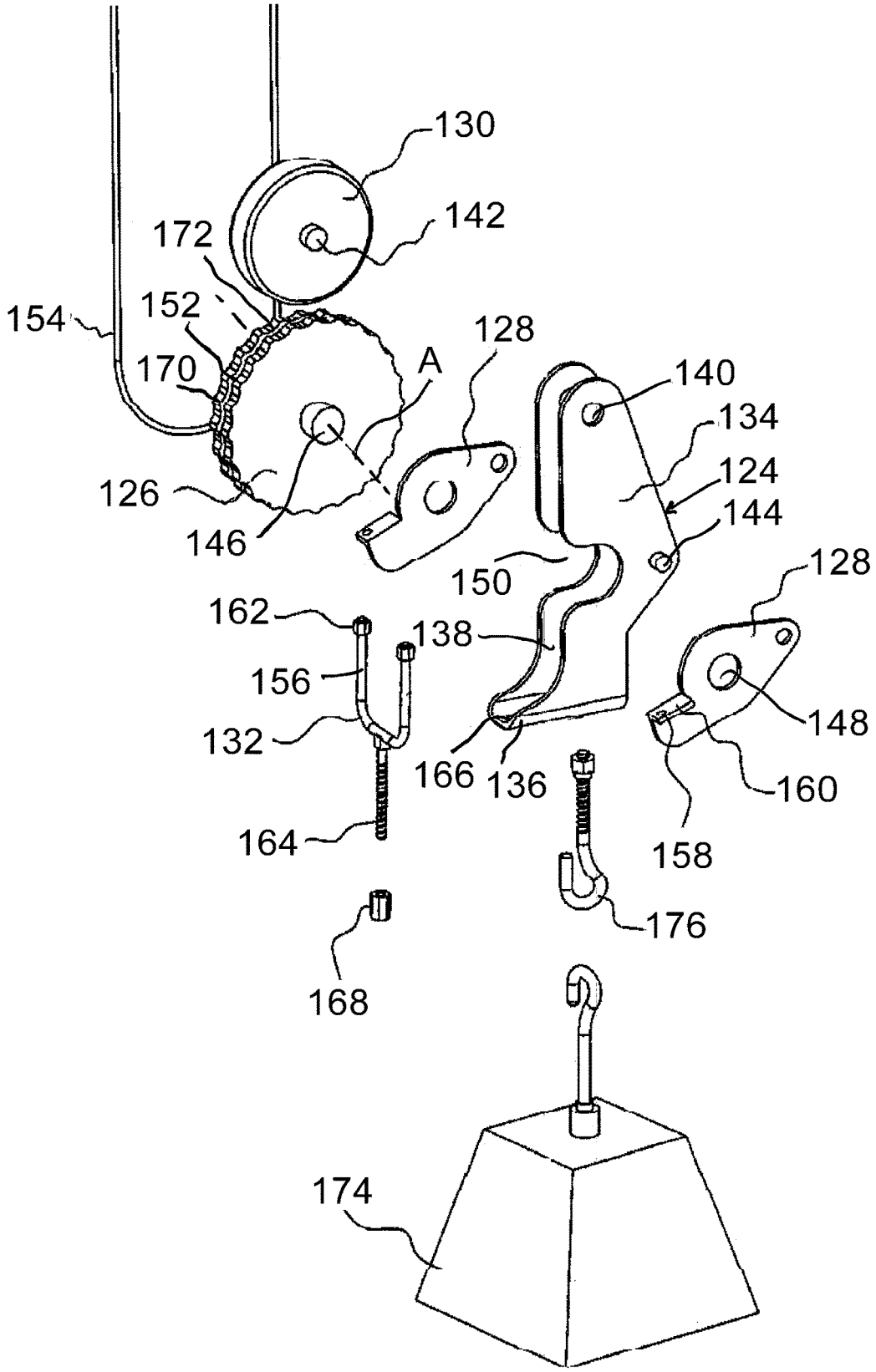
FIG. 3 is an exploded perspective view of the vibration pulley system shown in FIG. 1.

Referring now to FIG. 3, the upper portions of the side members 134 of the bracket 124 may include through holes 140 in axial alignment. The contact roller 130 may be rotatably secured between the side members 134 of the bracket 124 by roller shafts 142 projecting from opposite sides of the contact roller 130. The roller shafts 142 extend through the through holes 140 of the bracket side members 134 so that a portion of the contact roller 130 extends into the channel 138 of the bracket 124.

The toothed pulley 126 may be rotatably supported within the channel 138 of the bracket 124 below the contact roller 130 in substantial vertical alignment therewith. The toothed pulley 126 may be movably supported by the toothed pulley supports 128 which in turn are pivotally secured to the bracket 124 at pivot pins 144 which are fixedly secured to the bracket side members 134.

The toothed pulley 126 may include substantially planar sides transverse to the rotational axis of the toothed pulley 126. Studs 146, coaxial with the rotational axis A of the toothed pulley 126, may project outwardly from the planar sides of the toothed pulley 126. The studs 146 may extend transverse to the channel 138 through notched regions 150 of the bracket side members 134 and received through holes 148 formed in the toothed pulley supports 128. The notched regions 150 may be sufficiently large to permit vertical movement of the toothed pulley 126 relative to the bracket 124.

The toothed pulley 126 may include a circumferential groove 152 which may be generally deeper than the diameter of a pulley cable 154 engaged with the toothed pulley 126. Generally, the pulley cable 154 may be wrapped or extend around the toothed pulley 126 about one hundred eighty degrees (180°) or less. In some instances, however, the pulley cable 154 may be looped one or more times (unillustrated) around the toothed pulley 126 to ensure adequate friction present to cause rolling contact between the toothed pulley 126 and the contact roller 130. In such instances, the circumferential groove 152 may be sufficiently deep so that no contact occurs between a looped pulley cable 154 and the contact roller 130.

The yoke 132 may interconnect the toothed pulley supports 128 to the bracket 124. The yoke 132 may include arms 156 having threaded distal ends. The threaded distal ends of the yoke arms 156 may be received through holes 158 formed in flange members 160 of the toothed pulley supports 128. Retaining nuts 162 may threadedly secure the yoke 132 to the toothed pulley supports 128. The yoke 132 may include a threaded stud 164 extending downward through a hole 166 in the base member 136 of the bracket 124. An adjusting knob 168 may be threaded on the stud 164.

The toothed pulley 126 may include generally equally spaced circumferential teeth 170 and valleys 172 where maximum oscillating vibrations may be generated as the contact roller 130 rolls into each valley 172 and over each tooth 170 of a given tooth height.

In some embodiments, a weight 174 may be hung from a hook 176 fixedly secured to the base member 136 of the bracket 124. As shown in FIG. 1, one end of the pulley cable 154 may the fixedly secured to the frame arm 114 and threaded through the channel 152 about the toothed pulley 126 and over a pair of pulleys 178, 180 rotatably mounted on the frame arm 114. The opposite end of the pulley cable 154 may be connected to a handle 178.

While performing a lat pull down exercise on an exercise machine, such as, but without limitation, the exercise apparatus 100, vibration during the exercise may be introduced when the pulley cable 154 is under tension and the toothed roller 126 is in rolling contact with the contact roller 130. In some embodiments the toothed pulley 126 and the contact roller 130 may both be fabricated of hard materials, such a metal and hard plastic. In such embodiments, tooth deformation may not occur and vibrations may be minimal. In other embodiments, the toothed pulley 126 may be fabricated of hard materials in rolling contact with a contact pulley 130 fabricated of relatively soft materials. Soft materials may minimize noise.

Figure 4A:
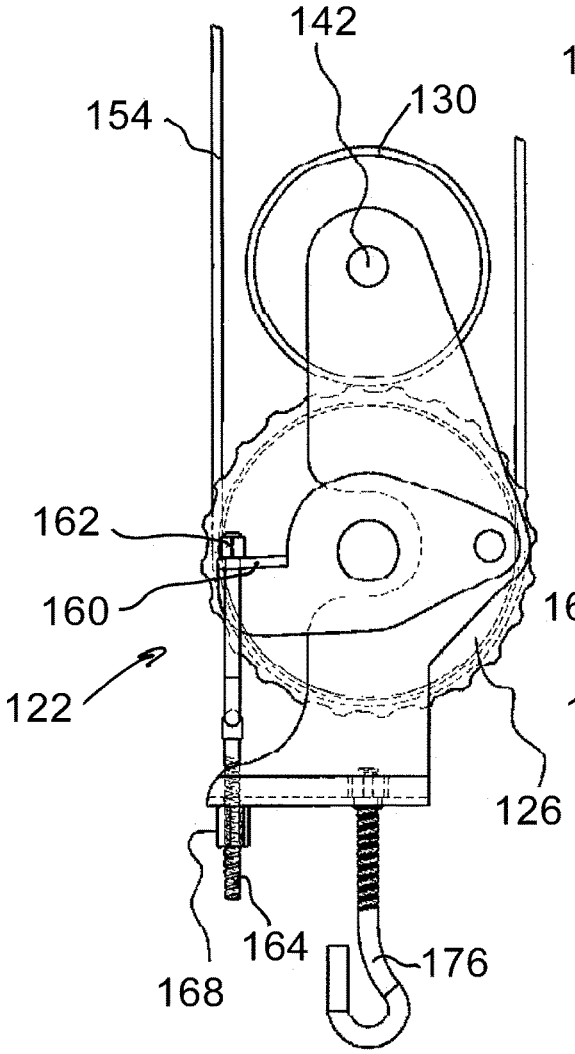
FIGS. 4A and 4B are partial side views of the vibration pulley system shown in FIG. 1/
Figure 4B:
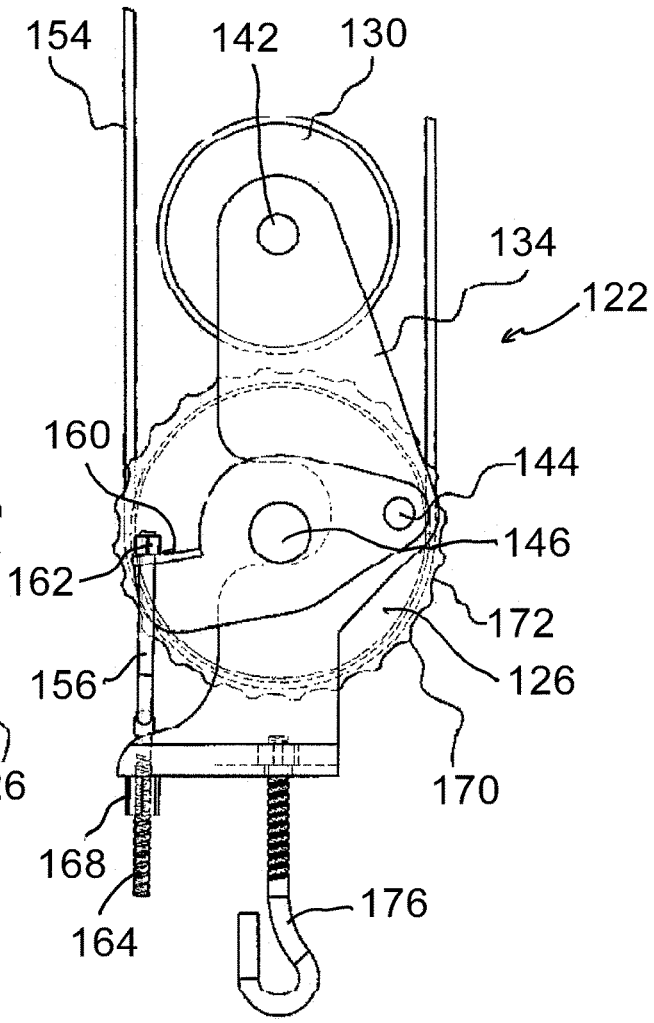
Figure 5A:
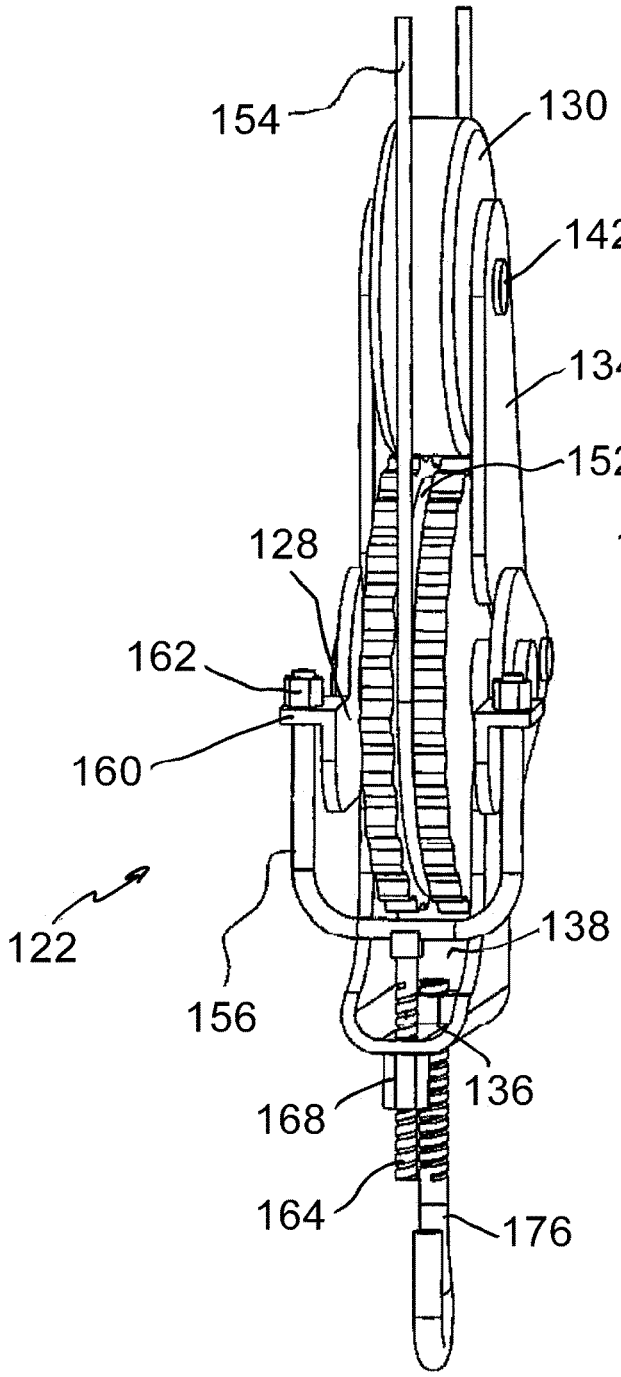
FIGS. 5A and 5B are partial front perspective views of the vibration pulley system shown in FIG. 1.
Figure 5B:
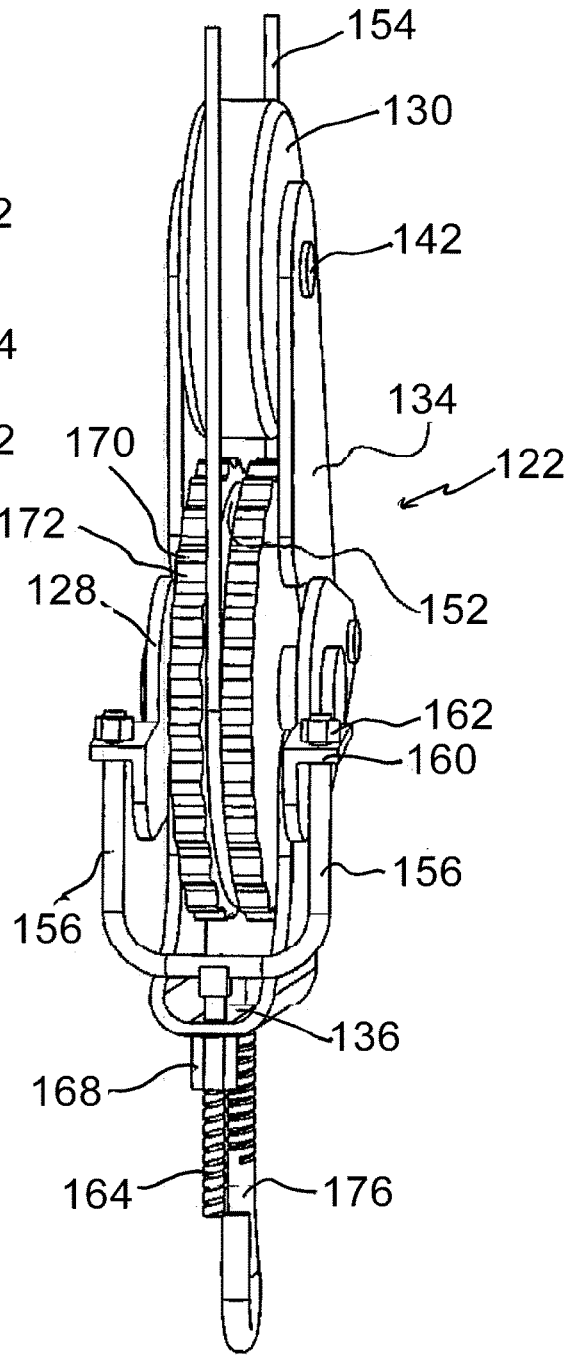

During operation of the exercise apparatus 100, the intensity of vibrations felt by an operator may be adjusted. The adjusting knob 168 may be set by the operator to change the intensity of the vibrations. That is, as the adjusting knob 168 in threaded on the yoke stud 164, the toothed pulley supports 128 pivot downwardly about pivot pins 144 and thereby move the toothed pulley 126 downward in the channel 138 so that it is not in contact with the contact roller 130, as shown in FIG. 4B. In such a configuration, no vibrations will be imparted to the pulley cable 154. The operator may thus vary the vibration force to a desired level.

Figure 6A:
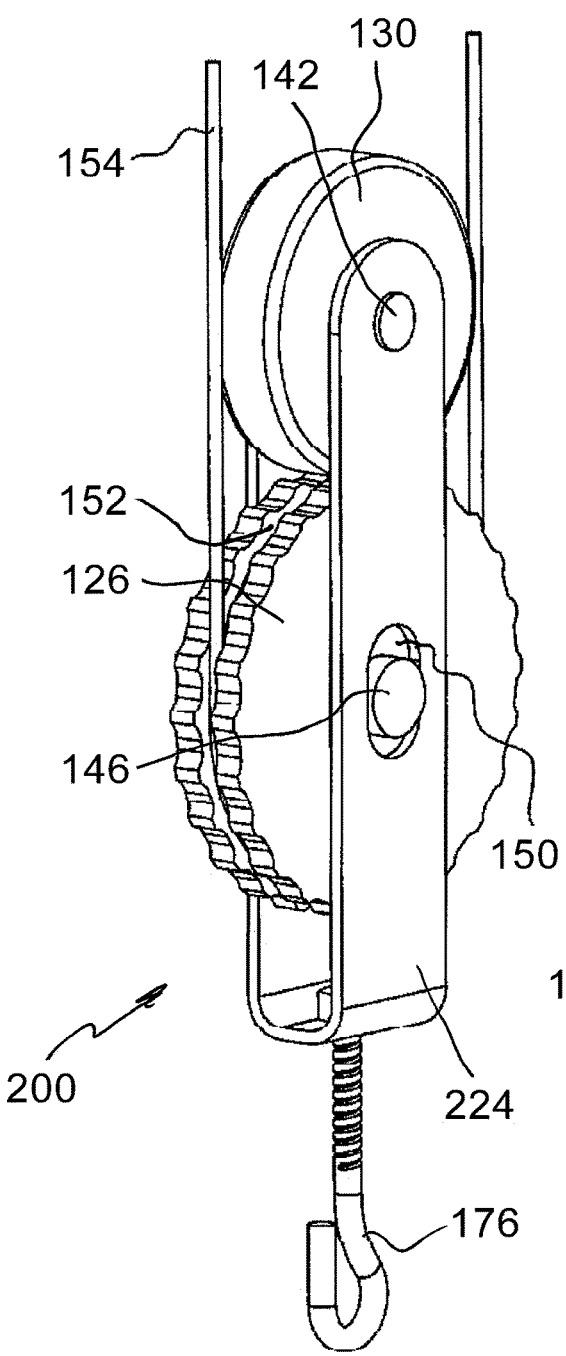
FIGS. 6A and 6B are partial perspective view of a second embodiment of a vibration pulley system.
Figure 6B:
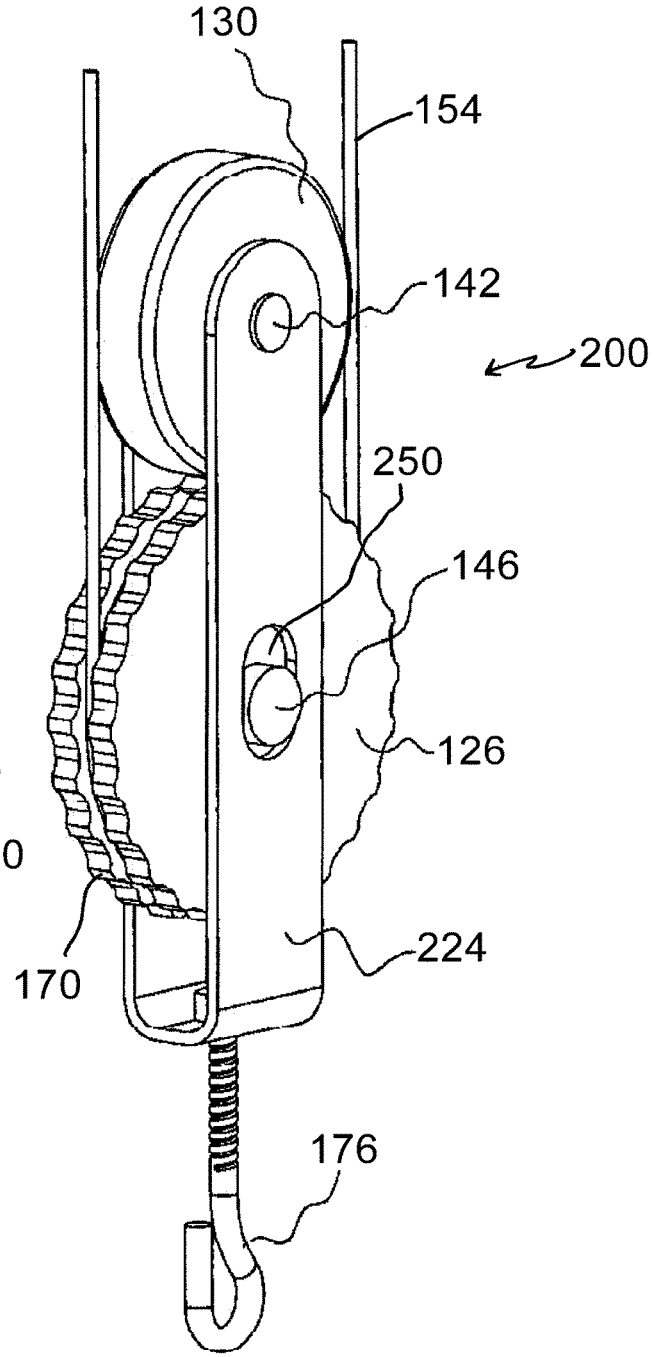

Referring now to FIG. 6A and FIG. 6B, a second illustrative embodiment of a vibration pulley system for an exercise apparatus is generally identified by the reference numeral 200. As indicated by the use of common reference numerals, the vibration pulley system 200 is similar to the vibration pulley system 120 of the exercise apparatus 100 described hereinabove with the exception that the vibration intensity of the vibration pulley system 200 is not adjustable. As the toothed pulley 126 rotates it is in constant contact with the contact roller 130. The toothed pulley 126 may be linearly constrained to reciprocate in the slot 250 formed in the bracket 224 as the contact roller 130 counter rotates with the toothed pulley 126. The vibration pulley system 120 may provide constant vibrations while the pulley cable 124 is under tension causing the toothed pulley 126 to rotate.

Figure 7:
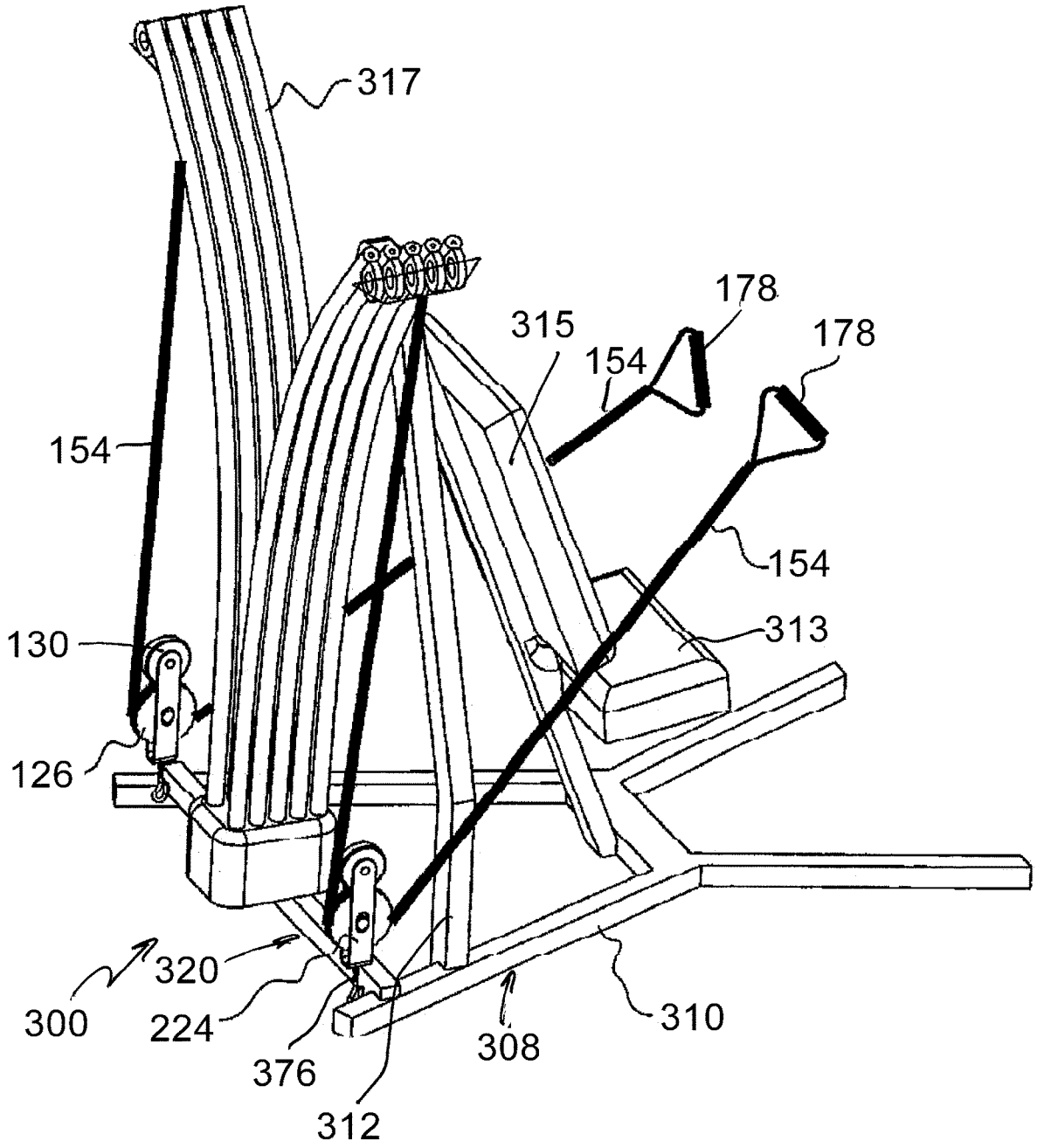
FIG. 7 is a perspective view of an exercise apparatus including a third embodiment of a vibration pulley system.

Referring now to FIG. 7, a third illustrative embodiment of an exercise apparatus incorporating a vibration pulley system is generally identified by the reference numeral 300. As indicated by the use of common reference numerals, exercise apparatus 300 is similar to the exercise apparatus 100 described hereinabove. The exercise apparatus 300 may include a frame 308, a base 310, stanchions 312 extending vertically upward from the base 310, a seat 313, a backrest 315 and flexible rods 317 fixedly secured to the base 310 extending vertically upward therefrom. A hook 376 may connect a vibration pulley system 320 similar to the vibration pulley system 200 described hereinabove to the base 310. A pulley cable 154 includes an end connected to the flexible rods 317. The pulley cable 154 may be threaded about the toothed pulley 126 which is in constant engagement with the contact roller 130. The opposite end of the pulley cable 154 may be connected to a handle 178. The vibration pulley system 320 includes two vibration pulley systems 320 connected to opposite sides of the base 310 so that an operator may sit on the seat 313 and grasp a handle 178 in each hand. The flexible rods 317 provide resistance so that the pulley cable 154 is under tension as the exercise is performed.

While a preferred embodiment of the invention has been shown and described, other and further embodiments of the invention may be devised without departing from the basic scope thereof, and the scope thereof is determined by the claims which follow.

The invention claimed is:

1. An exercise apparatus, comprising:

a) a frame movably supporting a vibration pulley assembly;

b) said vibration pulley assembly including:

i) a toothed pulley;

ii) a contact roller;

iii) a bracket rotatably supporting said toothed pulley and said contact roller in vertically spaced relationship to one another; wherein said bracket include notched regions permitting vertical movement of said toothed pulley relative to said bracket for selective engagement of said toothed pulley with said contact roller; and iv) a cable wrapped at least partially about said toothed pulley imparting rotation to said toothed pulley during performance of an exercise, wherein a first end of said cable is secured to said frame and a second end of said cable is secured to a handlebar.

2. The exercise apparatus of claim 1 wherein said bracket includes spaced apart side members, said contact roller rotatably secured between said spaced apart side members at least partially extending into a channel defined by said spaced apart side members.

3. The exercise apparatus of claim 2 including toothed pulley support members pivotally connected to said spaced apart side members of said bracket, said toothed pulley support members rotatably supporting said toothed pulley within said channel.

4. The exercise apparatus of claim 3 including a yoke interconnecting said toothed pulley support members and said bracket.

5. The exercise apparatus of claim 1 further including a weight removably suspended from said bracket.

6. An exercise apparatus, comprising:

a) a frame movably supporting a vibration pulley assembly;

b) said vibration pulley assembly including:

i) a toothed pulley;

ii) a contact roller;

iii) a bracket rotatably supporting said toothed pulley and said contact roller in vertically spaced relationship to one another; wherein said bracket include notched regions permitting vertical movement of said toothed pulley relative to said bracket for selective engagement of said toothed pulley with said contact roller; and iv) a cable wrapped at least partially about said toothed pulley imparting rotation to said toothed pulley during performance of an exercise.

7. The exercise apparatus of claim 6 including toothed pulley support members pivotally connected to said bracket, said toothed pulley support members rotatably supporting said toothed pulley.

8. The exercise apparatus of claim 6 further including a weight removably suspended from said bracket.

9. An exercise apparatus, comprising:

a) a frame;

b) a vibration pulley assembly including:

i) a toothed pulley;

ii) a contact roller;

iii) a bracket rotatably supporting said toothed pulley and said contact roller in vertically spaced relationship to one another, said bracket including spaced apart side members defining a channel;

iv) a cable wrapped at least partially about said toothed pulley imparting rotation to said toothed pulley during performance of an exercise; and v) toothed pulley support members pivotally connected to said bracket, said toothed pulley support members rotatably supporting said toothed pulley within said channel of said bracket.

* * * * *